United States Patent [19]

Chick

[11] Patent Number: 4,750,722

[45] Date of Patent: Jun. 14, 1988

[54] SUPPLEMENTAL MACHINE VISE

[76] Inventor: James P. Chick, Rd #3, Butler, Pa. 16001

[21] Appl. No.: 763,289

[22] Filed: Aug. 7, 1985

[51] Int. Cl.[4] ..... B25B 1/10

[52] U.S. Cl. ..... 269/110; 269/155; 269/244; 269/271; 269/282

[58] Field of Search ..... 269/97, 104, 110, 154, 269/155, 240, 244, 257, 259, 262, 271, 279, 280, 282, 152; 408/103, 108; 409/225, 903

[56] References Cited

U.S. PATENT DOCUMENTS

| | | | |
|---|---|---|---|
| 1,187,856 | 6/1916 | Moss | 269/152 X |
| 1,225,301 | 5/1917 | Wolfe | 269/97 |
| 1,355,143 | 10/1920 | Hanson | 269/240 |
| 1,718,864 | 6/1929 | McLean | 269/280 |
| 1,961,036 | 5/1934 | Boyle | 269/110 X |
| 1,973,238 | 9/1934 | Walter | 269/152 X |
| 2,123,131 | 7/1938 | Zugermayer | 269/110 X |
| 2,176,608 | 10/1939 | Marsilius | 269/152 X |
| 2,723,579 | 11/1955 | Johnson | 269/155 |
| 4,043,547 | 8/1977 | Glomb et al. | 269/244 X |
| 4,054,281 | 10/1977 | Martinsson | 269/110 |
| 4,216,950 | 8/1980 | Mason et al. | 269/271 |

FOREIGN PATENT DOCUMENTS

| | | | |
|---|---|---|---|
| 263354 | 11/1949 | Switzerland | 269/240 |
| 1265960 | 3/1972 | United Kingdom | 269/240 |

*Primary Examiner*—Frederick R. Schmidt
*Assistant Examiner*—Steven P. Schad

[57] ABSTRACT

In precision machining, a workpiece can be rapidly located with respect to three mutually perpendicular datum planes by positioning it within both a main machine vise and a supplemental machine vise held within the main machine vise, with the supplemental machine vise being one that has an overall length extending beyond the grip of the main machine vise, ground and polished planar side surfaces adapted to be positioned so that one of them is in contact with the substantially planar ground and polished bed surface of the main machine vise, and a ground and polished substantially planar base surface on the supplemental vise, which is adapted to be abutted, usually but not necessarily in a vertical position, against the working interior face of the fixed jaw of the main machine vise. The supplemental vise may be either secured to the fixed jaw in the same manner that its removable jaw plate would be, if it were present, or by bolting or otherwise securing it to a retainer member located exteriorly of the fixed jaw of the main machine vise.

3 Claims, 4 Drawing Sheets

SUPPLEMENTAL MACHINE VISE

BACKGROUND OF THE INVENTION

1. Field of the Invention

This invention relates to the precision machining of workpieces, and in particular, it relates to a method of machining such workpieces, using a supplemental vise which is located within the grip of a larger, main machine vise.

2. Description of the Prior Art

In the precision machining of workpieces, especially ones which have three mutually perpendicular surfaces, it is known that when the task at hand is to position such a workpiece within a vise in accordance with the methods known before the present invention, it is necessary to take the time to use a square to line up one surface of the workpiece, and there is further delay involved when using an edge locator in order to find another datum with respect to the location of the workpiece. This is all, according to the teachings of the present invention, needlessly time-consuming.

It is known, moreover, from the prior art that one can affix a supplemental vise to the fixed jaw of a main machine vise which is suitably attached to the main bed of a machine tool—see U.S. Pat. No. 1,971,069. In the above-mentioned patent, however, although the supplemental vise is located such that its bed and its base surface extend substantially in a vertical direction, with the base of the vise extending in a substantially vertical plane, the practice disclosed in the '069 patent is one in which the supplemental vise is mounted exteriorly of the grip of the main machine vise, rather than being received within it.

SUMMARY OF THE INVENTION

In precision machining, a workpiece can be rapidly located with respect to three mutually perpendicular datum planes by positioning it within both a main machine vise and a supplemental machine vise held within the main machine vise, with the supplemental machine vise being one that has an overall length extending beyond the grip of the main machine vise, ground and polished planar side surfaces adapted to be positioned so that one of them is in contact with the substantially planar ground and polished bed surface of the main machine vise, and a ground and polished substantially planar base surface on the supplemental vise, which is adapted to be abutted, usually but not necessarily in a vertical position, against the working interior face of the fixed jaw of the main machine vise. The supplemental vise may be either secured to the fixed jaw in the same manner that its removable jaw plate would be, if it were present, or by bolting or otherwise securing it to a retainer member located exteriorly of the fixed jaw of the main machine vise.

DESCRIPTION OF THE DRAWINGS

A complete understanding of the invention may be obtained from the foregoing and the following description thereof, taken in conjunction with the appended drawings, in which.

DESCRIPTION OF THE PREFERRED EMBODIMENTS

Figure 1:
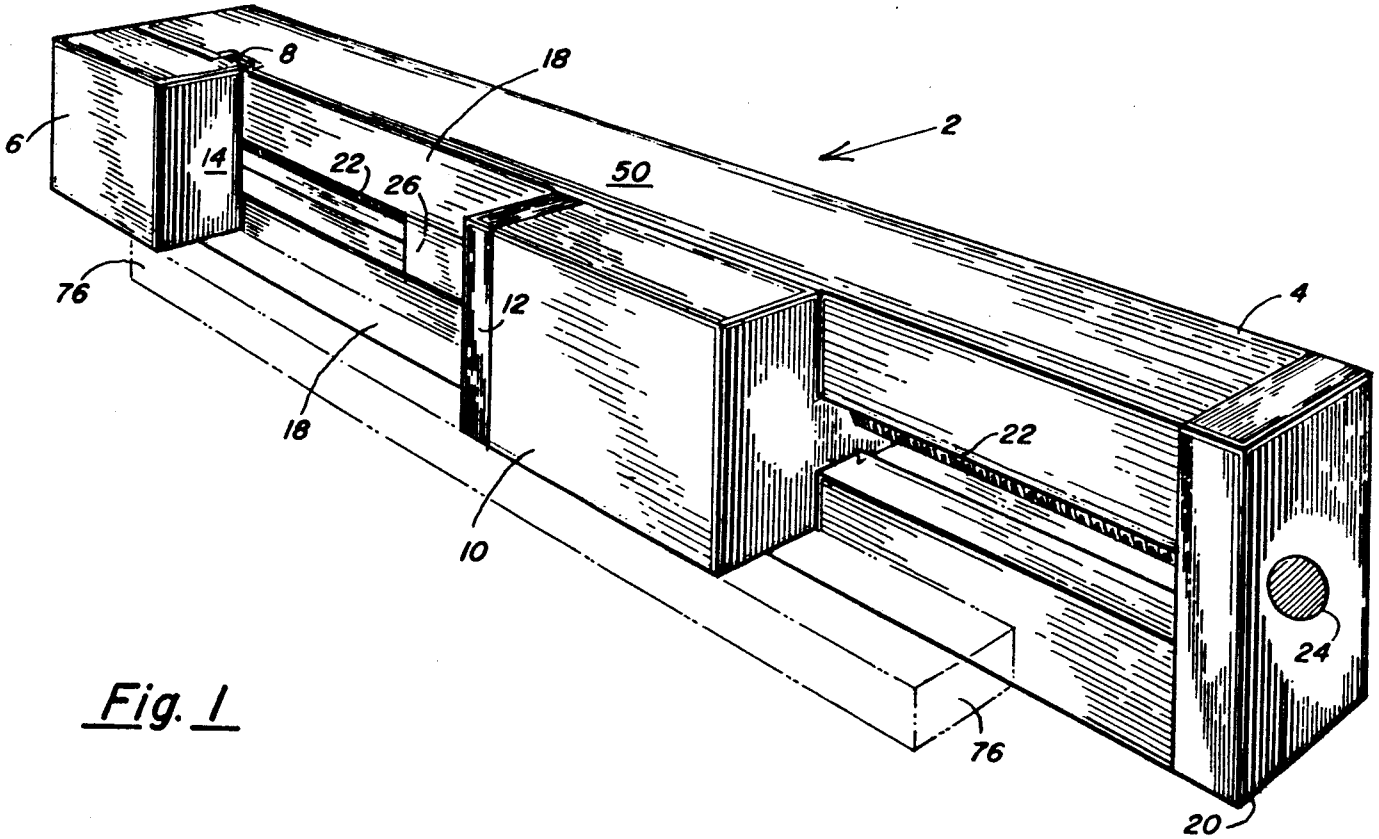
FIG. 1 is a perspective view of one form of supplemental vise in accordance with the present invention.

In FIG. 1 there is shown a perspective view of one form of a supplemental vise, indicated generally at 2, according to the present invention. It comprises a base member 4, a fixed-jaw member 6 which is keyed into the member 4 as shown at 8, and a movable jaw member 10 which preferably has a face-plate member 12.

Figure 7:
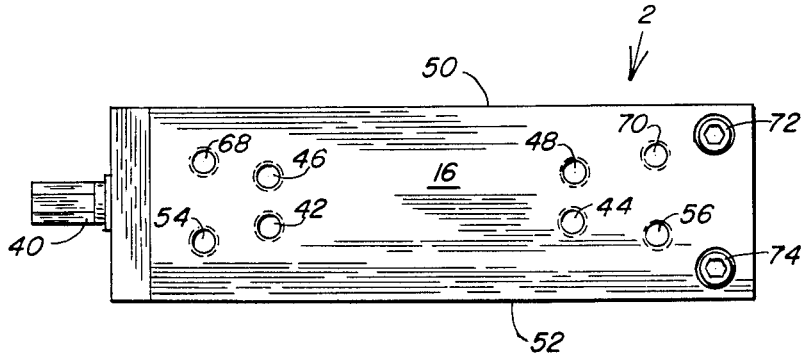
FIG. 7 is a rear elevation view of a supplemental vise according to the invention, detached from any of the means used to secure it to any larger main machine vise.

It is to be understood that the supplemental vise according to the invention has, for reasons which will be well understood by those familiar with the art of precision machining, a number of surfaces which are substantially planar and are provided with ground and polished finishes. The working surface 14 of the fixed jaw of the supplemental vise 2 is one such surface. The surface 16, which is the unshown back of the vise 2 as shown in FIG. 1 but which is viewed head-on in elevation in FIG. 7, is another such surface. The working face of the above-mentioned face plate 12 is another such surface. There is also the bed surface 18 of the supplemental vise 2, which is of such nature, i.e., substantially planar and with a ground and polished finish. There is also the surface (unnumbered in FIG. 1 but terminating in the line 20) upon which the vise 2, as shown in FIG. 1, sits.

The supplemental vise 2 has its movable jaw member 10 arranged for movement toward and away from the fixed-jaw member 6 by means of a screwshaft 22, which terminates at its end 24 by connection with the means for revolving the same such as those hereinafter more particularly described. The movable jaw member 10 may thus be caused to travel toward or away from the surface 14 of the fixed-jaw member 6, sliding along the surface 18, with which the projecting part 26 of the movable jaw member 10 is coplanar.

Those skilled in the art will understand that the supplemental vise 2, as well as the main machine vise within whose grip it is positioned in the practice of the invention, may be provided with various features of structure which are not particularly herein shown and described but which are intended to serve the purpose of making the vise more suitable for use in precision machining work, combatting the tendency of the vise to become bowed when a relatively high gripping pressure is applied to the workpiece, as is often necessary in order to insure against any unwanted or unintended movement thereof during the precision machining operation; to the extent that such measures or features are adopted and prove effective, it becomes possible in precision machining work to take heavier cuts while maintaining the desired degree of precision, thereby affording a more rapid and efficient precision machining operation.

Another factor which importantly influences the overall efficiency of precision machining operation is the readiness with which workpieces may be positioned and secured within the grasp of the vise or vises which hold them while being precisely located with respect to a plurality of datum planes. The need for and the usefulness of a device such as the supplemental vise 2, with its planar, polished back, bottom, top, bed and face-jaw surfaces, in respect to making such setup more rapid and efficient, will be more apparent as the description progresses and is completed.

Figure 2:
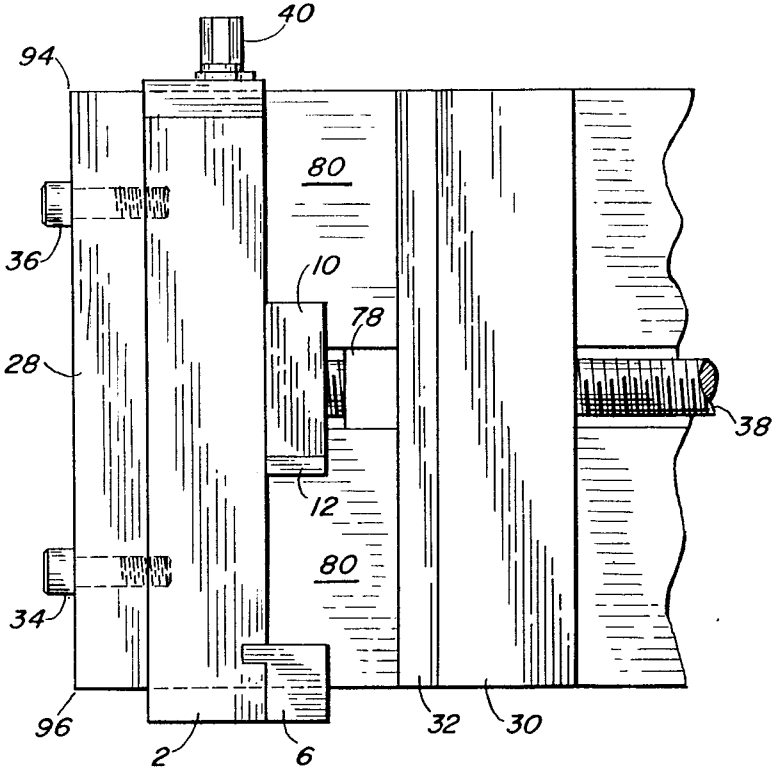
FIG. 2 is a partial plan view, showing a manner of mounting a supplemental vise according to the invention within the grip of a larger main machine vise.
Figure 6:
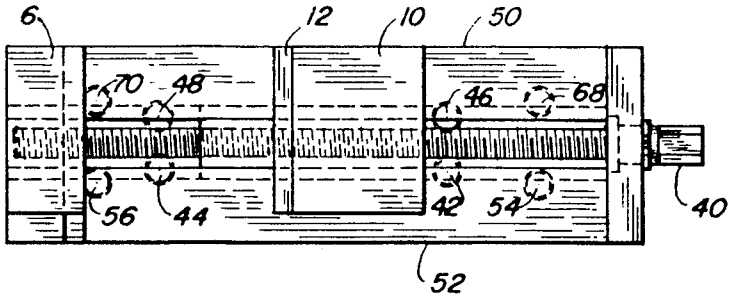
FIG. 6 is a further view, an elevation view in orthographic projection of the apparatus as shown in FIG. 3.

In FIG. 2, there is shown in plan view how supplemental vise 2 may be secured, in a first way, to the fixed jaw 28 of a larger main machine vise, and within the grip of it formed by its fixed jaw 28 and its movable jaw member 30, which is shown as having a face-plate 32, preferably suitably affixed thereto by customary means (not shown). As shown in FIG. 2, the vise 2 may be affixed to the fixed jaw 28 of the main machine vise by means of bolts 34, 36 which pass through openings in the fixed-jaw member 28 and are otherwise customarily used for securing a face plate to the fixed jaw 28. Also shown in FIG. 2 is the screw-shaft 38 of the main machine vise. The end 24 of the screw-shaft 22 of the supplemental vise 2 is shown in FIG. 2 as being provided with a hexagonal head 40, which may be connected with the customary means (not shown) for causing it to be rotated, to move the movable jaw 10 of the supplemental vise 2 toward its fixed-jaw member 6. Not shown in FIG. 2 are the customary means for rotating the screwshaft 38 and the customary means for securing the larger main machine vise to the bed of the machine such as a milling machine, boring machine, drill press, etc.

Referring to FIG. 7, which is a view from the rear of the supplemental vise 2 shown in FIG. 1, there are indicated a number of holes or openings, the purposes of which will now be explained. When the supplemental vise 2 is attached to the fixed jaw 28 of the main machine vise by means of the bolts 34, 36 shown in FIG. 2, the ends of those bolts are secured in the openings 42, 44. It will be understood by those skilled in the art that the openings 46 and 48 may similarly be used to secure the supplemental vise 2 to the fixed jaw 28 in place of its face plate for the occasions in which the surface 50 is put into contact with the ground and polished planar bed surface of the main machine vise, instead of the surface 52.

Figure 5:
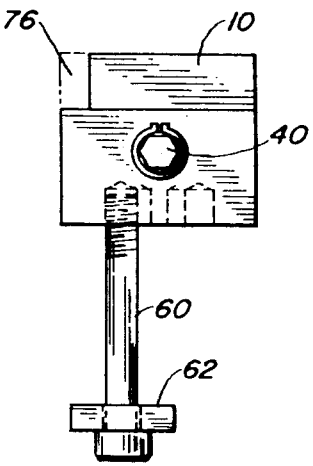
FIG. 5 is a right elevation view of the apparatus shown in FIG. 3.
Figure 3:
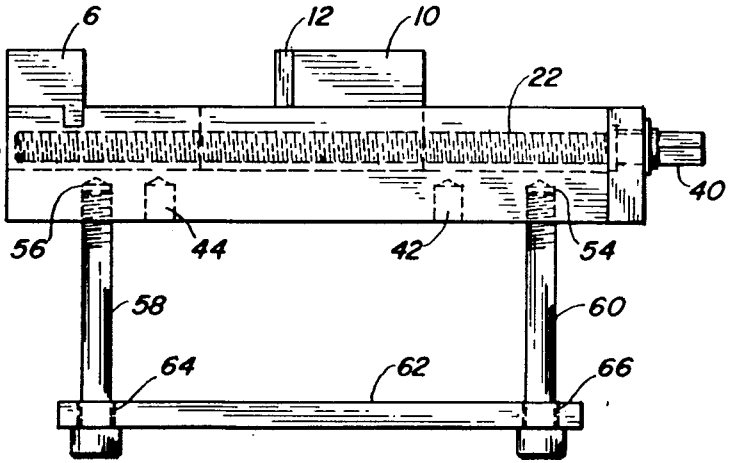
FIG. 3 is a plan view of a supplemental vise according to the invention, showing a second manner of mounting a supplemental vise according to the invention within the grip of a larger machine vise.
Figure 4:
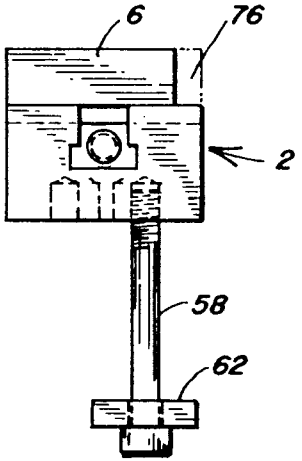
FIG. 4 is left elevation view of the apparatus shown in FIG. 3.

Moreover, as shown in FIG. 7, the surface 16 is provided with another pair of openings 54, 56, which are internally threaded and serve to receive bolts 58, 60 whenever the supplemental vise 2 is secured within the main machine vise by an alternative means, such as that shown in FIGS. 3, 4, and 5 inclusive. In this manner of securing the supplemental vise 2 to the fixed jaw 28, there is provided a keeper or strap member 62 which is provided with suitably located openings 64, 66, through which the bolts 58 and 60 are passed, as shown. Referring once again to FIG. 7, the openings 68 and 70 will likewise receive the bolts 58 and 60, when the surface 50 is rested against the bed surface of the main machine vise, instead of having the surface 52 rested against it.

Also shown in FIG. 7 are the countersunk screws 72 and 74 which serve to secure the fixed-jaw member 6 to the remainder of the supplemental vise 2. It will be apparent to those skilled in the art that the bolts 58, 60 and their corresponding holes or openings need to be spaced at least somewhat farther apart than the width of the fixed jaw 28 of the main machine vise.

In one embodiment of the present invention, as shown, for example, in FIGS. 4 and 5, and somewhat less obviously in FIG. 1, it is arranged that the working faces of the supplemental vise 2 do not extend for its full width or height, but rather, there is left, toward in the end of the working face 14 of the fixed jaw which is towards the bed surface of the main machine vise a gap or opening 76, which may be on the order of $\frac{1}{4}$ to $\frac{3}{8}$ inch in width. The reason for having the supplemental vise 2 so constructed is that this will make it possible to insert a suitable parallel member against the bed surface of the main machine vise, such that the parallel member, which is generally in the form of a rectangular prism, bridges over the gap 78, as seen in FIG. 2, between the two portions 80 of the bed surface of the main machine vise.

Figure 8:
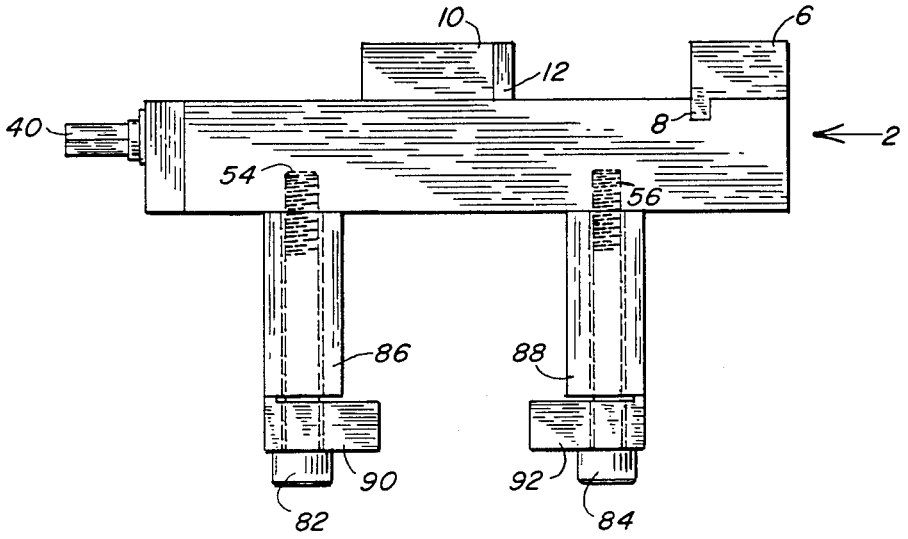
FIG. 8 is a plan view of a supplemental vise according to the invention, together with still another means for securing it within the grip of a larger main machine vise.

In yet another method of affixing the supplemental vise 2 according to the invention to the fixed jaw 28 of the main machine vise, there is the possibility depicted in FIG. 8 of using bolts 82 and 84 which extend through collar members 86, 88, and clamp members 90, 92. It is to be understood that the clamp members 90, 92 fit snugly around the corners 94, 96 of the fixed jaw 28 of the main machine vise, as shown in FIG. 2, with the result that with this mode of affixing the supplemental vise 2 to the fixed jaw 28 of the main machine vise, it is possible to keep in place, if desired, other equipment affixed to the rear of said fixed jaw, such as a work-stop means.

The method of using the apparatus described above will be apparent to those skilled in the art. In particular, use of the apparatus of the invention, to position a workpiece having three mutually perpendicular exterior surfaces with respect to three mutually perpendicular datum planes, will easily be possible. When the supplemental vise of the invention is affixed within the grip or grasp of the main machine vise in the manner indicated above and in the drawings, then the working surface of the fixed jaw 6 of the supplemental vise 2 will form one datum plane, and the bed surface 18 of the supplemental vise 2 will form a second one. A third datum will be afforded by the bed surface of the main machine vise, which will also be, as indicated above, substantially planar, with a ground-and-polished surface. This will make it possible instantly to place any rectilinear workpiece within the structure contemplated in accordance with the present invention, getting it into a desired position instantly without the use of squares or the like.

While I have shown and described herein certain embodiments of my invention, I intend to cover as well any change or modification therein which may be made without departing from its spirit and scope.

I claim as my invention:

1. A structure for receiving and gripping securely a workpiece possessing three mutually perpendicular exterior substantially planar surfaces in such a manner that said workpiece is precisely located with respect to three mutually perpendicular datum planes, said structure comprising a first machine vise for precision work having its planar exterior base secured to the bed of a machine tool, said first machine vise having a planar ground and polished bed and a planar ground and polished working face of a fixed-jaw member thereof, a second machine vise for precision work, said vise having a ground and polished planar exterior base face and at least one ground and polished planar exterior side face, a fixed jaw having a ground and polished planar working face, a movable jaw having a ground and polished planar working face located opposingly in respect to said face of said fixed jaw, an interior ground and polished planar bed surface, and screw means for causing gripping and and releasing movements, respectively, of said movable jaw as said movable jaw is moved towards and away from said fixed jaw, means affixing said second machine vise between said fixed-jaw member and a movable-jaw member of said first machine vise, with the planar exterior base face of said second vise abutting against said fixed-jaw member of said first machine vise and with a planar ground and polished side face of said second vise abutting against a ground and polished planar bed area of said first machine vise.

2. A method of rapidly positioning for precision machining a workpiece so that it is precisely located with respect to three datum planes which are mutually perpendicular, said method comprising providing both (a) a larger main machine vice having a substantially planar ground and polished bed and a substantially planar ground and polished fixed jaw and (b) a supplemental vice which is capable of being affixed to said larger main machine vice in a location between its jaws and is also capable of being removed as a unit therefrom, said supplemental machine vice being capable of being so positioned that its base extends in a generally vertical direction and is abutted against the fixed jaw of said main machine vice, said supplemental machine vice having ground and polished planar side surfaces, a ground and polished planar bed surface, a ground and polished base surface and a ground and polished working surface of its fixed jaw, said method comprising further the steps of positioning said supplemental vice within said main machine vice with the base of said supplemental vice abutted against the fixed jaw of said main machine vice, positioning said workpiece within said supplemental vice in which it is held within said main machine vice in a manner such that said workpiece abuts and is located by reference planes provided by the bed of said supplemental vice,the fixed jaw of said supplemental vice, and the substantially planar ground and polished bed of said main machine vice, and tightening the movable jaws of said main machine vice and said supplemental vice to secure said workpiece in position.

3. A method as defined in claim 2, characterized in that it further comprises the step, before inserting the workpiece within said vises, of securing said supplemental vise to the fixed jaw of said main machine vice by removing a removable jaw plate thereof and threadingly affixing a base surface of said supplemental machine vise to the working surface of said fixed jaw of said main machine vise.

* * * * *